US007579561B2

(12) United States Patent
Wee et al.

(10) Patent No.: US 7,579,561 B2
(45) Date of Patent: Aug. 25, 2009

(54) KEYPAD COUPLING APPARATUS FOR PORTABLE TERMINAL

(75) Inventors: Jong-Cheon Wee, Yongin-si (KR); Hong-Bae Kim, Yongin-si (KR); Jae-Shik Kim, Seongnam-si (KR)

(73) Assignee: Samsung Electronics Co., Ltd (KR)

( * ) Notice: Subject to any disclaimer, the term of this patent is extended or adjusted under 35 U.S.C. 154(b) by 0 days.

(21) Appl. No.: 11/935,247

(22) Filed: Nov. 5, 2007

(65) Prior Publication Data

US 2008/0105526 A1 May 8, 2008

(30) Foreign Application Priority Data

Nov. 6, 2006 (KR) ..... 10-2006-0108884

(51) Int. Cl.
*H01H 13/70* (2006.01)

(52) U.S. Cl. ..... 200/5 A; 200/517; 200/296; 341/22; 345/168

(58) Field of Classification Search ..... 200/5 A, 200/5 R, 511, 512, 517, 341, 343, 344, 345, 200/296; 341/20, 22; 345/156, 168, 169
See application file for complete search history.

(56) References Cited

U.S. PATENT DOCUMENTS 4,066,850 A * 1/1978 Heys, Jr. ..... 200/5 A
4,092,527 A * 5/1978 Luecke ..... 708/140
5,510,953 A * 4/1996 Merkel ..... 361/680
6,259,044 B1 * 7/2001 Paratore et al. ..... 200/5 A
6,495,784 B2 * 12/2002 Yoon et al. ..... 200/517
6,664,486 B2 * 12/2003 Yoon et al. ..... 200/5 A
7,088,340 B2 * 8/2006 Kato ..... 345/168
7,173,606 B2 * 2/2007 Honkala et al. ..... 345/169
7,235,755 B2 * 6/2007 Wang ..... 200/512
7,388,743 B2 * 6/2008 Lin ..... 361/680
7,415,846 B2 * 8/2008 Park ..... 68/3 R
7,463,480 B2 * 12/2008 Song ..... 361/680

FOREIGN PATENT DOCUMENTS

KR 1020060043042 5/2006

* cited by examiner

*Primary Examiner*—Michael A Friedhofer
(74) *Attorney, Agent, or Firm*—The Farrell Law Firm, LLP

(57) ABSTRACT

Disclosed is a keypad coupling apparatus for a portable terminal which has a laminated keypad unit arranged on an upper surface of a front case. The keypad coupling apparatus includes a front case provided with a latch; a flexible circuit disposed on the front case and including a plurality of dome switches; a keypad rubber disposed on an upper surface of the flexible circuit; and a keypad provided on an upper surface of the keypad rubber and moving in a pressed direction when the keypad is engaged with the latch and pressed, the keypad rubber making contact with at least one of the dome switches to provide tactile quality of a click.

8 Claims, 9 Drawing Sheets

KEYPAD COUPLING APPARATUS FOR PORTABLE TERMINAL

PRIORITY

This application claims priority to application filed with the Korean Intellectual Property Office on Nov. 6, 2006, and assigned Ser. No. 2006-108884, the contents of which are incorporated herein by reference.

BACKGROUND OF THE INVENTION

1. Field of the Invention

The present invention relates to a keypad coupling apparatus, and more particularly to a keypad coupling apparatus of a portable terminal, which includes a laminated keypad unit arranged on an upper surface of a front case of a portable terminal.

2. Description of the Related Art

In general, the term "portable communication terminals" refer to devices which a user can carry with him/her while communicating with another user wirelessly. Such portable communication devices include Hand-Held Phones (HHPs), CT-2, cellular phones, digital phones, Personal Communication System (PCS) phones, and Personal Digital Assistants (PDAs). Conventional portable terminals may be classified into various types according to their appearance, such as bar-type portable terminals, flip-type portable terminals, and folder-type portable terminals. The above-mentioned conventional portable terminals essentially include an antenna unit, data input/output units, and a data transmitter and receiver. Of course, a keypad is used as the data input unit, on which a user can press keys with his/her fingers to input data. The keypad used for inputting data includes a plurality of keys.

Hereinafter, the configuration of the bar-type portable terminal including a keypad and a liquid crystal display (LCD) unit will be described. As shown in FIG. 1, the bar-type portable terminal includes a single housing 1, a keypad 2, and an LCD unit 3. The keypad 2 and LCD unit 3 are arranged on a single housing 1. Further, the bar-type portable terminal includes a speaker unit 4 mounted over the LCD unit 3, and a microphone unit 5 disposed at a lower portion of the keypad 2.

The single housing 1 includes a front case 1*a* and a rear case 1*b*. The microphone unit 5 is soldered to a printed circuit board 6 mounted in the single housing 1.

A plurality of dome switches 6*a* is arranged on the printed circuit board 6.

A mounting space 7 for the microphone unit 5 is defined by the front case 1*a* and the rear case 1*b*.

As shown in FIG. 2, the keypad 2 is assembled with the front case 1*a* in such a manner of coupling the keypad 2 to a back surface of the front case 1*a* so as to be coupled with fixing ribs 1*c* formed in the front case 1*a*. The keypad 2 is exposed to the outside through keyholes 1*d* formed in the front case 1*a*. Thus, the keypad 2 is fixed to the front case 1*a* by means of the fixing ribs 1*c*.

In the conventional keypad, however, since a plurality of keys, arranged on the dome switches of the printed circuit board, and the key rubber are sequentially stacked on the back surface of the front case 1*a*, the keys are inserted in the keyholes 1*d* and assembled with the front case 1*a* in order to expose the keys to the outside through the keyholes of the front case. Accordingly, there is a problem in that increasing the thickness of the portable terminal runs counter to the desired slimness and the miniaturization of the portable terminal.

Further, since the portable terminal must have fixing ribs to secure the keypad, this causes an increase in the number of parts. Thus, there are disadvantages in that time to assemble the terminal increases, and manufacturing cost also increases.

SUMMARY OF THE INVENTION

Accordingly, the present invention has been made to solve the above-mentioned problems occurring in the prior art, and it is an aspect of the present invention to provide a keypad coupling apparatus for a portable terminal, in which a laminated keypad unit is mounted on an upper surface of a front case of the portable terminal, thereby reducing time for assembling the keypad.

It is another aspect of the present invention to provide a keypad coupling apparatus for a portable terminal, in which a laminated keypad unit is mounted on an upper surface of a front case of the portable terminal, and fixing ribs, which are used for fixing a keypad to a back surface of the front case, are not required, thereby achieving slimness and miniaturization of the portable terminal.

It is still another aspect of the present invention to provide a keypad coupling apparatus for a portable terminal, in which a laminated keypad is mounted on an upper surface of a front case of the portable terminal, and fixing ribs, which are used for fixing a keypad to a back surface of the front case, are not required, thereby reducing the number of parts and manufacturing cost.

In order to accomplish these aspects of the present invention, there is provided a keypad coupling apparatus for a potable terminal, which includes a front case provided with a latch; a flexible circuit disposed on the front case and including a plurality of dome switches; a keypad rubber disposed on an upper surface of the flexible circuit; and a keypad provided on an upper surface of the keypad rubber and moving in a pressed direction when the keypad is engaged with the latch and pressed, the keypad rubber making contact with the dome switch to provide tactile quality of click.

BRIEF DESCRIPTION OF THE DRAWINGS

The above and other aspects, features, and advantages of the present invention will be more apparent from the following detailed description taken in conjunction with the accompanying drawings, in which.

DETAILED DESCRIPTION OF THE PREFERRED EMBODIMENT

Hereinafter, a preferred embodiment of the present invention will be described in detail with reference to the accompanying drawings.

Figure 1:
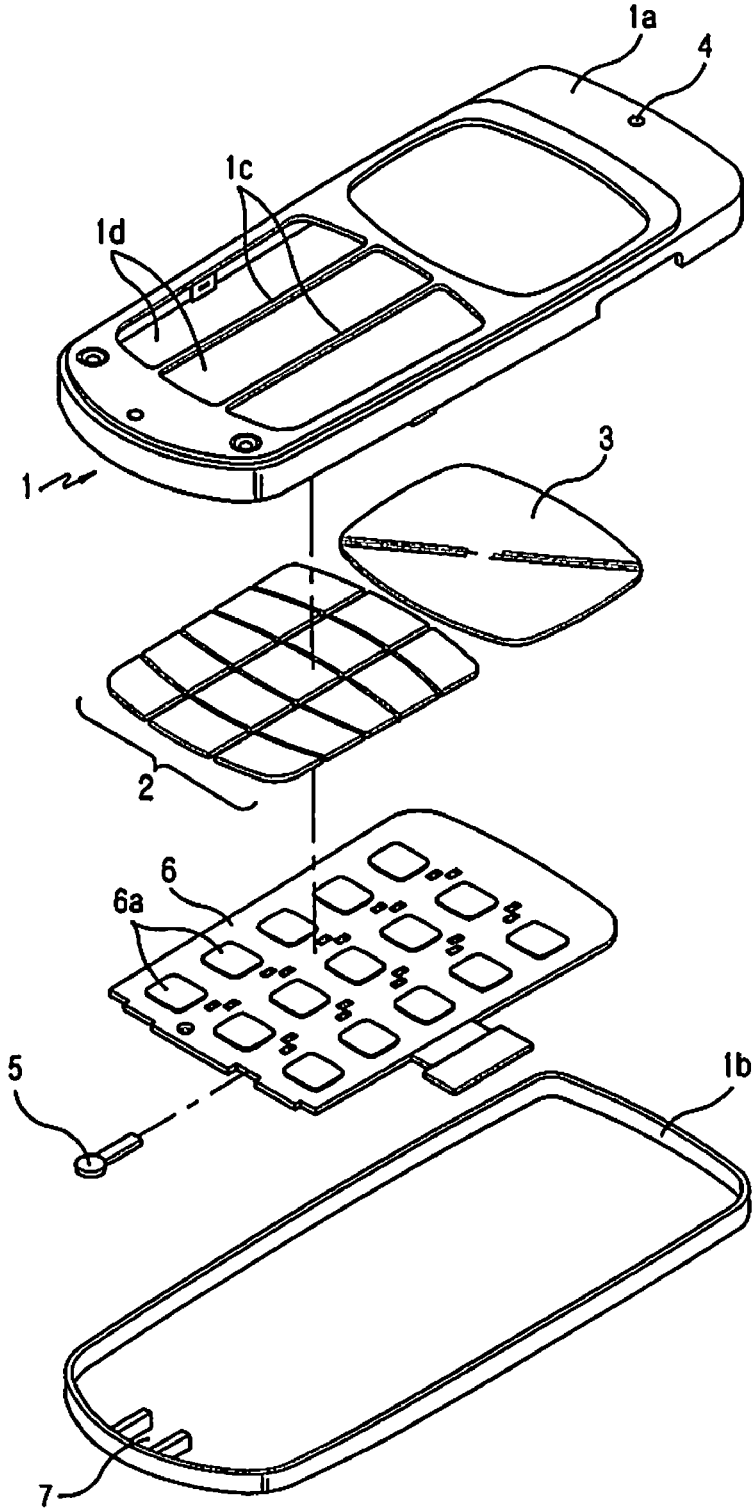
FIG.1 (PRIOR ART)
FIG. 1 is an exploded perspective view showing a conventional bar-type portable terminal, in which a keypad is shown.
Figure 2:
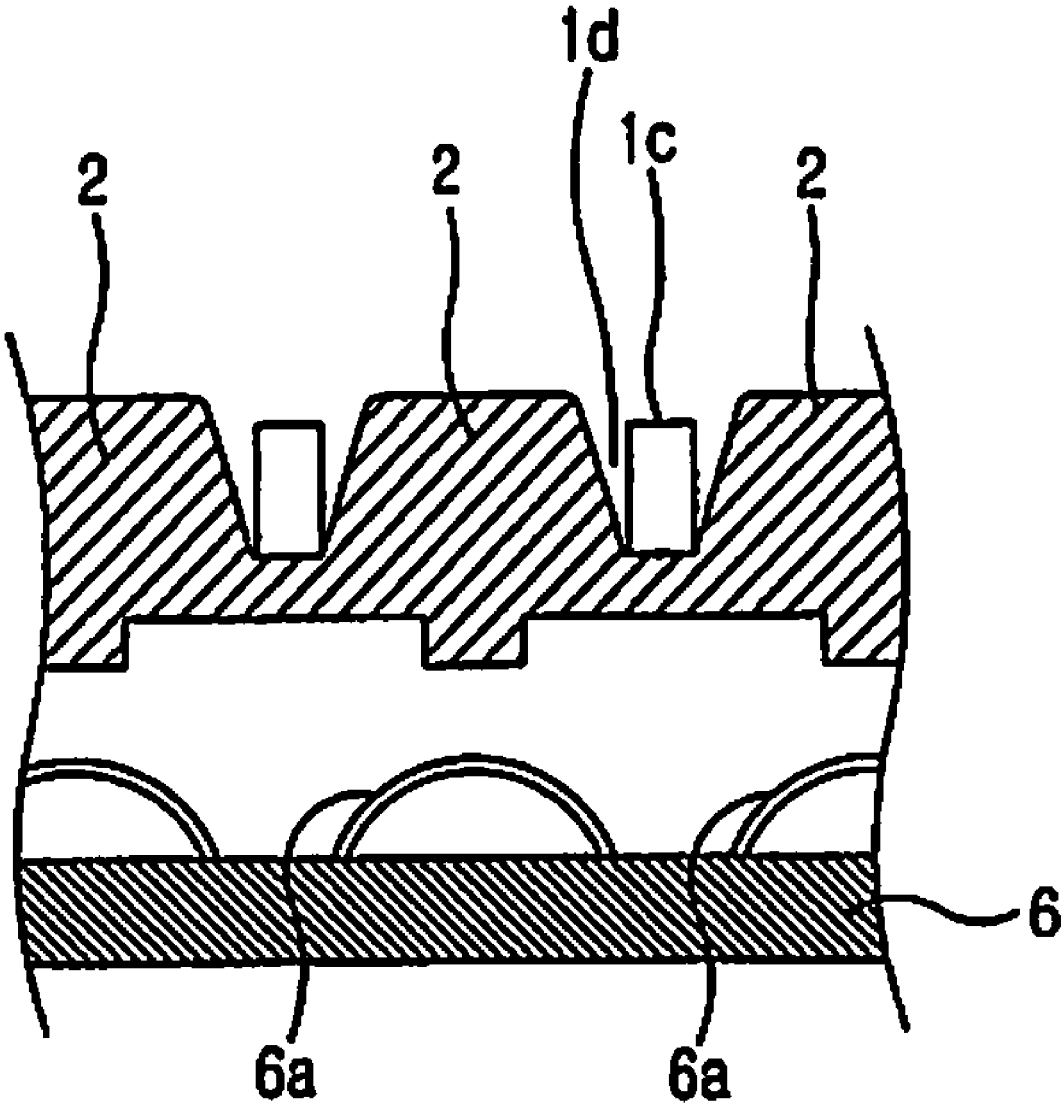
FIG.2 (PRIOR ART)
FIG. 2 is a sectional view showing the conventional bar-type portable terminal, in which the combination state of the keypad of FIG. 1 is shown.
Figure 3:
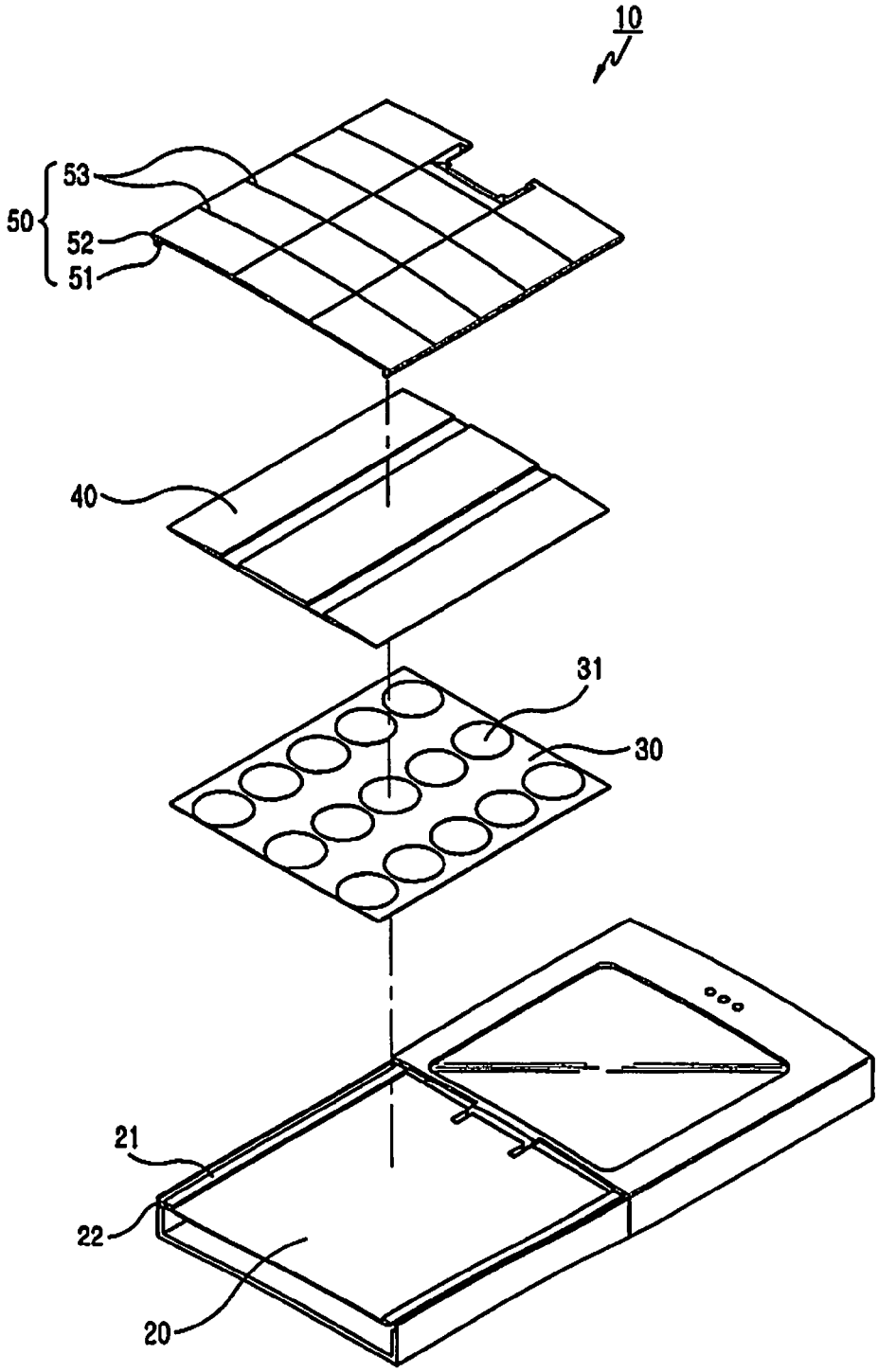
FIG. 3 is an exploded perspective view showing a configuration of a keypad coupling apparatus of a portable terminal according to the present invention.
Figure 4:
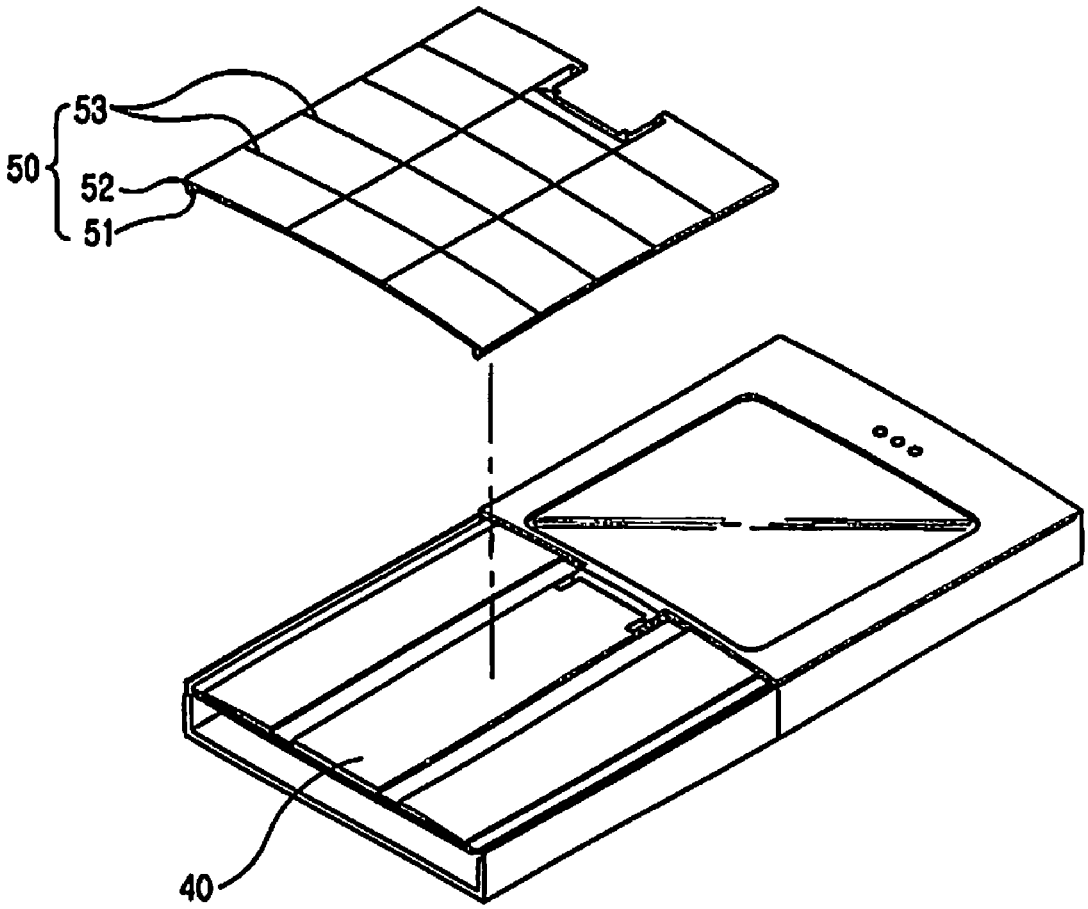
FIG. 4 is a perspective view showing a process of coupling the keypad coupling apparatus of the portable terminal according to the present invention.
Figure 5:
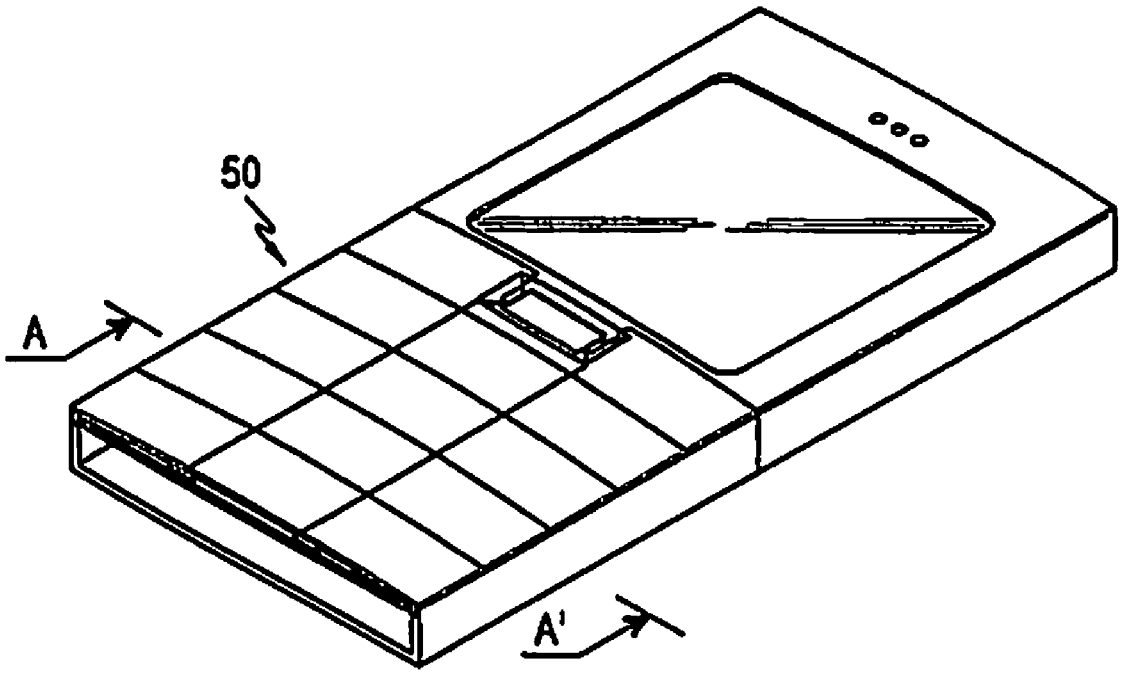
FIG. 5 is a perspective view showing the portable terminal according to the present invention, in which the keypad coupling apparatus is coupled with the portable terminal.

As shown in FIGS. 3, 4, and 5, a keypad coupling apparatus 10 of a portable terminal includes a front case 20, a flexible circuit 30, a keypad rubber 40, and a keypad unit 50. The front case 20 is provided with a latch 21 which latches onto and couples with the keypad unit 50. The flexible circuit 30 has a plurality of dome switches 31, which are arranged on an upper surface of the front case 20 so as to make contact with the contacting protrusions 41 (FIG. 6) of the keypad rubber 40, respectively, when the keypad unit 50 is pressed. The keypad rubber 40 is disposed on an upper surface of the flexible circuit 30 so that the contacting protrusion 41 of the keypad rubber 40 comes into contact with the dome switch 31 when the keypad unit 50 is pressed.

Figure 6:
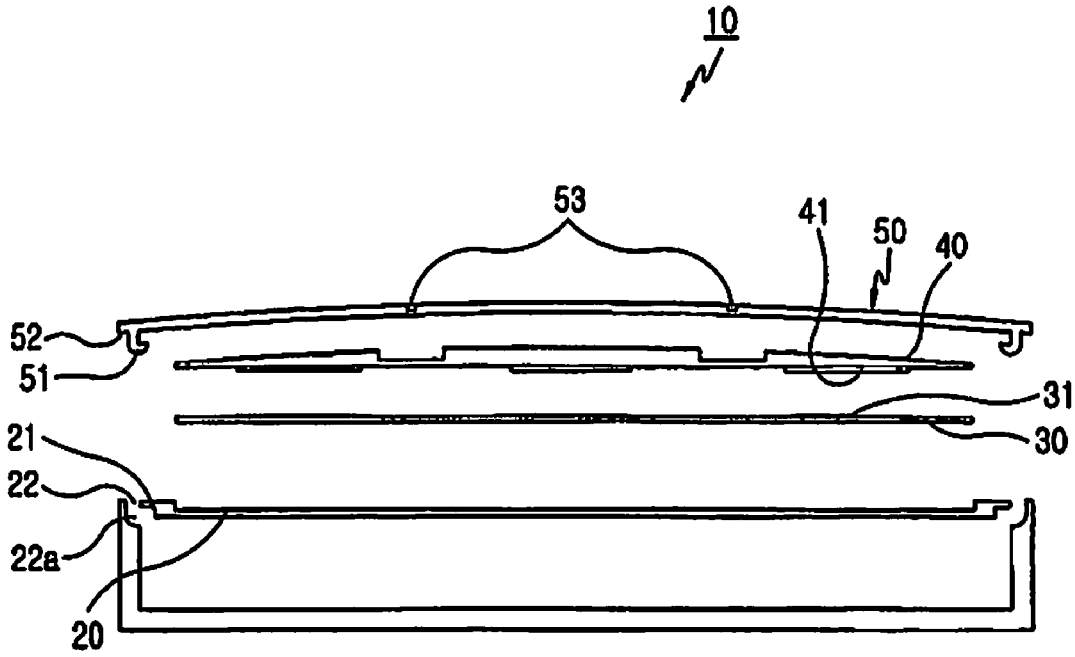
FIG. 6 is an exploded sectional view showing the portable terminal, taken along line A-A' in FIG. 5, in which the keypad coupling apparatus is shown.
Figure 7:
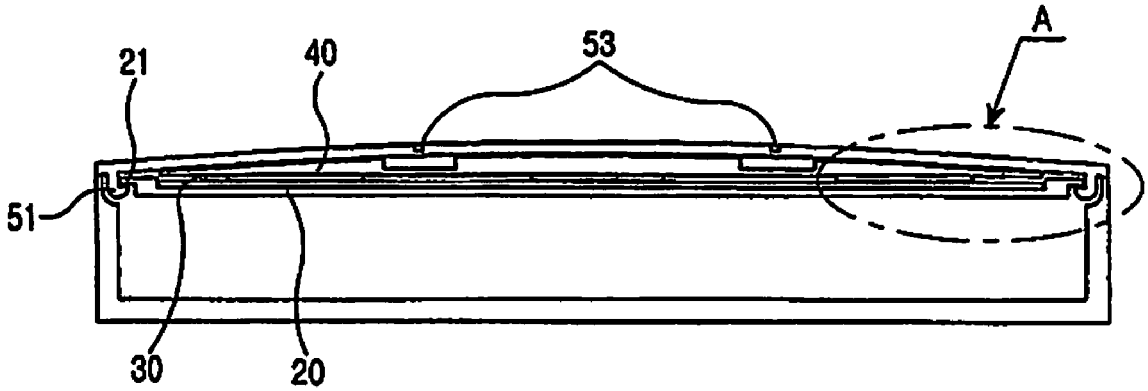
FIG. 7 is a sectional view showing the portable terminal, taken along line A-A' in FIG. 5.
Figure 8:
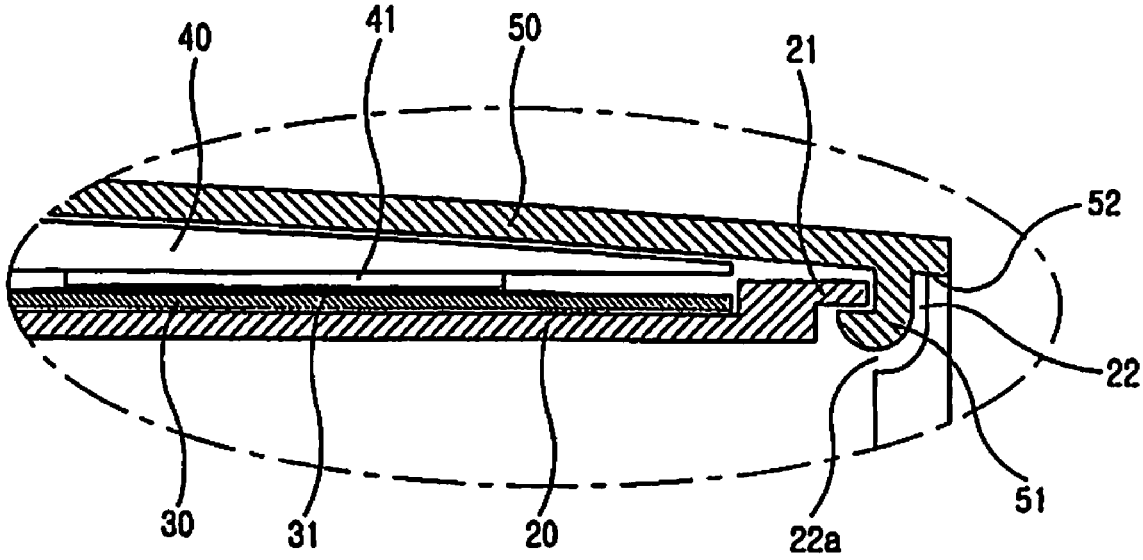
FIG. 8 is an enlarged sectional view showing the keypad coupling apparatus, marked by an ellipse A in FIG. 7.

As shown in FIGS. 6, 7, and 8, the keypad unit 50 is secured to front case 20 by a latch 21 and moves in a pressed direction when the keypad unit 50 is pressed. The keypad unit 50 is disposed on an upper surface of the keypad rubber 40 so that the contacting protrusion 41 of the keypad rubber 40 comes into contact with the dome switch 31 and thereby provides the feel of click as the keypad unit 50 is pressed.

As shown in FIGS. 7 and 8, the front case 20 has insertion portions 22 formed at both sides thereof, in which hook portions 51 are inserted and latched by the latches 21, respectively. The respective insertion portion 22 has the latch 21 formed therein, which is engaged with the hook portion 51 so as to prevent the keypad unit 50 from being released from the front case 20. Further, the insertion portion 22 has a click space 22*a* formed therein, in which the hook portion 51 moves along the keypad unit 50 in a pressed direction to provide the keypad unit 50 with the feel of click as the keypad unit 50 is pressed.

As shown in FIG. 6, the keypad unit 50 includes the flexible circuit 30 and the keypad rubber 40, which are stacked on the upper surface of the front case 20. In this state, the keypad unit 50 is disposed on the upper surface of the keypad rubber 40 and coupled to the keypad rubber 40.

Figure 9:
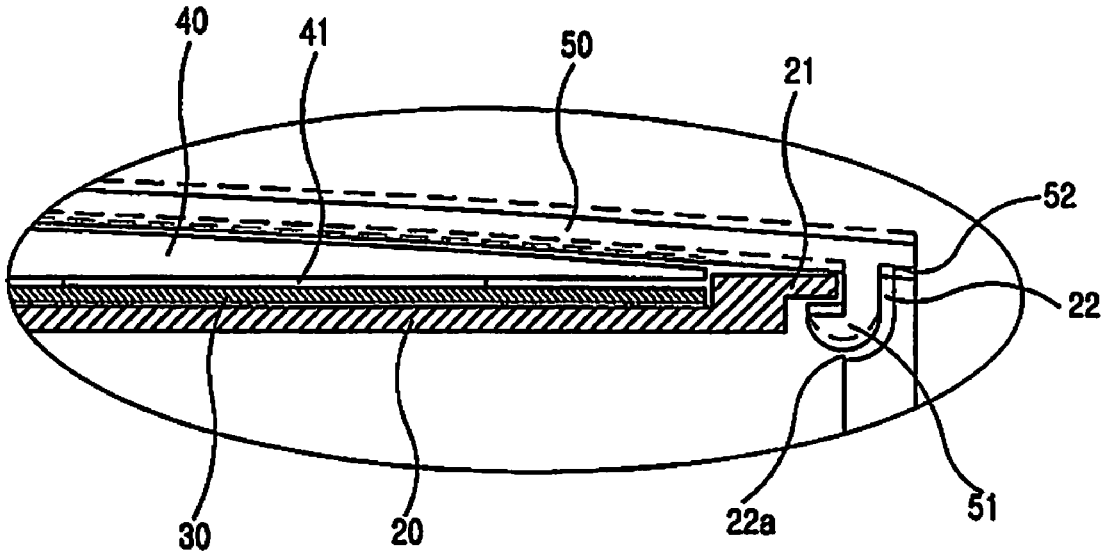
FIG. 9 is an enlarged sectional view showing the operation of the keypad coupling apparatus, marked by the ellipse A in FIG. 7.

As shown in FIGS. 8 and 9, the keypad unit 50 has the hook portions 51 formed on both sides thereof, which are engaged with the latch portions 21. The hook portion 51 has a distal end with a desired curvature in order to allow the keypad unit 50 to easily couple with the insertion portion of the front case 20 when the keypad unit 50 is coupled with the front case 20. The keypad unit 50 has contacting surfaces formed at both sides thereof, which come into contact with upper ends of both sidewalls of the front case 20, respectively, so that the keypad unit 50 is supported by the sidewalls of the front case 20 when the keypad unit 50 is pressed.

As shown in FIG. 6, a plurality of pressing grooves 53 is formed on the upper surface of the keypad unit 50 so as to make it possible for a user to press the keypad unit 50.

Hereinafter, the operation of the keypad coupling apparatus for the portable terminal according to the present invention constructed as described above will be described in detail with reference to FIGS. 3 to 9.

As shown in FIGS. 3, 4, and 5, the keypad coupling apparatus 10 for the portable terminal includes the front case 20 with the latch 21, the flexible circuit 30, the keypad rubber 40, and the keypad unit 50. The flexible circuit 30 having the dome switches 31 is disposed on the upper surface of the front case 20. The keypad rubber 40 is disposed on the upper surface of the flexible circuit 30. On the keypad rubber 40 is disposed the keypad unit 50.

As shown in FIGS. 6 and 7, at this time, the hook portion 51 of the keypad unit 50 is engaged with the latch 21 of the front case 20. Since the latch 21 of the front case 20 is formed in the insertion portion 22, the hook portion 51 is inserted into the insertion portion 22 and simultaneously latched by and engaged with the latch 21.

In this state, as shown in FIGS. 8 and 9, when a user presses the upper surface of the keypad unit 50, the keypad unit 50 moves in the pressed direction. At this time, the hook portion 51 also moves. Since the insertion portion 22 has a click space defined, in which the hook portion 51 moves along with the keypad unit 50 in the pressed direction to provide the tactile sensation or quality of a click of the keypad unit 50 when the keypad unit 50 is pressed, the hook portion 51 moves into the click space 22*a*, so that the keypad unit 50 is pressed. Further, the keypad rubber 40 is pressed by means of the keypad unit 50, and the contacting protrusion 41 formed on the keypad rubber 40 makes contact with the dome switch 31 so as to provide the feel of a click.

As shown in FIG. 9, when the keypad unit 50 is pressed, the click space 22*a* is provided so that the hook portion 51 of the keypad unit 50 can move. The hook portion 51 is prevented by means of the latch 21 from being released from the front case 20.

The keypad unit 50 has the contact surfaces 52 formed at both sides thereof, which come into contact with the upper ends of both sidewalls so as to support the keypad unit 50 so that the keypad unit 50 is pressed against the front case 20.

Further, the keypad unit 50 has a plurality of pressing grooves 53 formed thereon, which allow the keypad unit 50 to be pressed when a user presses the keypad unit 50.

As described above, the keypad unit has a configuration in which it is mounted on the upper surface of the front case of the portable terminal. Therefore, the keypad unit is coupled to the upper surface of the front case, thereby making it possible to reduce time to assemble the keypad unit. Further, since a fixing rib is unnecessary when the keypad unit is assembled with the front case, it is possible to achieve slimness and miniaturization of the portable terminal.

The present invention is applicable to all kinds of portable terminals.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A keypad coupling apparatus for a portable terminal, comprising:

a front case provided with at least one latch and at least one click space;

a flexible circuit disposed on the front case and including a plurality of dome switches;

a keypad rubber disposed on an upper surface of the flexible circuit; and a keypad provided on an upper surface of the keypad rubber, the keypad having at least one hook portion engaged with the at least one latch in the at least one click space to secure the keypad to the front case, the at least one hook portion moving in a pressed direction when the keypad is pressed in the pressed direction, the keypad rubber providing a tactile quality of a click while making contact with at least one of the dome switches.

2. The keypad coupling apparatus as claimed in claim 1, wherein the front case further has an insertion portion formed at both sides of the front case, the insertion portion receiving the at least one hook portion.

3. The keypad coupling apparatus as claimed in claim 2, wherein the at least one hook portion moves along with the keypad in the pressed direction to provide the tactile quality.

4. The keypad coupling apparatus as claimed in claim 2, wherein the at least one hook portion has a distal end having a predetermined curvature.

5. The keypad coupling apparatus as claimed in claim 1, wherein the flexible circuit is mounted on a top surface of the front case.

6. The keypad coupling apparatus as claimed in claim 1, wherein the keypad further has contacting surfaces which make contact with both sidewalls the front case so that the keypad is pressed and supported against the front case.

7. The keypad coupling apparatus as claimed in claim 1, wherein the keypad further has a plurality of pressing grooves to allow the keypad to be pressed.

8. A keypad coupling apparatus for a portable terminal, comprising:

a front case having at least one latch and at least one click space; and a keypad mounted on a top surface of the front case, the keypad including a keypad rubber and a flexible circuit having a plurality of dome switches, the keypad having at least one hook portion engaged with the at least one latch in the at least one click space to secure the keypad to the front case, the at least one hook portion moving in a pressed direction to provide a tactile quality of a click when the keypad is pressed in the pressed direction.

* * * * *